United States Patent [19]

Rowinski

[11] 4,042,209

[45] Aug. 16, 1977

[54] NAIL-EXTRACTING APPARATUS

[76] Inventor: Anthony S. Rowinski, 2635 Rambling Way, Bloomfield Hills, Mich. 48013

[21] Appl. No.: 697,487

[22] Filed: June 18, 1976

[51] Int. Cl.[2] ..... B66F 15/00

[52] U.S. Cl. ..... 254/21

[58] Field of Search ..... 254/28, 21–27; 81/3 R, 418–420; 29/268

[56] References Cited

U.S. PATENT DOCUMENTS

| | | | |
|---|---|---|---|
| 758,017 | 4/1904 | Parish | 254/25 |
| 1,294,600 | 2/1919 | Baldwin | 254/28 |
| 2,186,333 | 1/1940 | Giersch | 254/25 |
| 2,488,484 | 11/1949 | Vander Clute | 81/420 |
| 3,357,085 | 12/1967 | Martin | 29/268 |

*Primary Examiner*—Al Lawrence Smith
*Assistant Examiner*—Robert C. Watson
*Attorney, Agent, or Firm*—Arnold S. Weintraub

[57] ABSTRACT

An apparatus is disclosed for removing fasteners, such as nails and the like. The apparatus includes a pair of pivotally attached levers each having handles at one end, while the opposite ends are provided with support members and claws which, respectively, engage the surface within which the fastener is embedded and the shank of the fastener. Upon the manual application of a force to the handles, the levers coact to apply a separating pressure between the fastener and the material within which the same is embedded to effect an axial withdrawal of the fastener.

4 Claims, 4 Drawing Figures

NAIL-EXTRACTING APPARATUS

CROSS REFERENCE TO RELATED PATENT APPLICATIONS

The present invention is related in substance to copending U.S. Pat. application Ser. No. 636,060 filed Nov. 28, 1975, in the name of Anthony S. Rowinski, and this application is incorporated herein by reference.

BACKGROUND OF THE INVENTION

I. Field of the Invention

The present invention relates to hand tools and, in particular, to an apparatus having levers for applying a separating pressure to a fastener for removing the same from a material within which the fastener is embedded.

II. Description of the Prior Art

Heretofore, numerous devices, apparatuses, and tools have been fabricated to facilitate the removal of a fastener from an object within which the fastener is embedded. Commonly, this is accomplished by using a pronged lever having tapering ends defining a V-shaped groove which is adapted to receive the shank of the embedded fastener. By proper manipulation of the tool at its fulcrum point, the fastener may be simply withdrawn. A common example of such a device is the claw end associated with conventional hammers. Such devices function in an acceptable manner; however, they do require a considerable amount of working room in order to be properly used and, when used in conjunction with dry-wall plasterboard which is commonly used in the construction of residential homes, commercial buildings, and the like, such claw hammers have a tendency to damage the wall during the application of a force upon the embedded fastener when removing the same. Likewise, there are many applications in which such claw-type tools, while of a simple construction, are not satisfactory for removing fasteners, such as nails and the like. Examples of other devices known in the prior art are disclosed in U.S. Pat. Nos. 612,833; 1,879,402; 3,314,320; 478,009; 828,625; 1,316,409; 1,644,081; 326,909; and 3,919,903.

SUMMARY OF THE INVENTION

The present invention, which will be described in greater detail hereinafter, comprises an apparatus for extracting embedded fasteners, such as nails and the like. The apparatus comprises a pair of levers complemented to each other for relative pivotal movement. The adjacent projecting ends of the levers are provided with a pair of support members and a pair of claw-like fingers nestled inbetween the support members. The support members engage the object into which the fastener is embedded, while the claw-like fingers engage the shank portion of the fastener for exerting a force against the fastener to effect the removal of the fastener from the object when the levers are acted upon.

It is therefore a primary object of the present invention to provide a new and improved apparatus for extracting embedded fasteners, such as nails and the like.

It is a further object of the present invention to provide such an apparatus which is of a simple construction comprising a pair of pivotally connected levers which are easy to operate for effecting the removal of an embedded nail and the like.

It is yet a further object of the present invention to provide an apparatus of the type disclosed for extracting embedded nails which is simple in construction and design and, thus, inexpensive to manufacture.

Other objects, advantages, and applications of the present invention will become apparent to those skilled in the art of apparatuses for removing embedded fasteners when the accompanying description of one example of the best mode contemplated for practicing the invention is read in conjunction with the accompanying drawing.

BRIEF DESCRIPTION OF THE DRAWING

The description herein makes reference to the accompanying drawing wherein like reference numerals refer to like parts throughout the several views, and wherein.

DESCRIPTION OF THE PREFERRED EMBODIMENT

Figure 1:
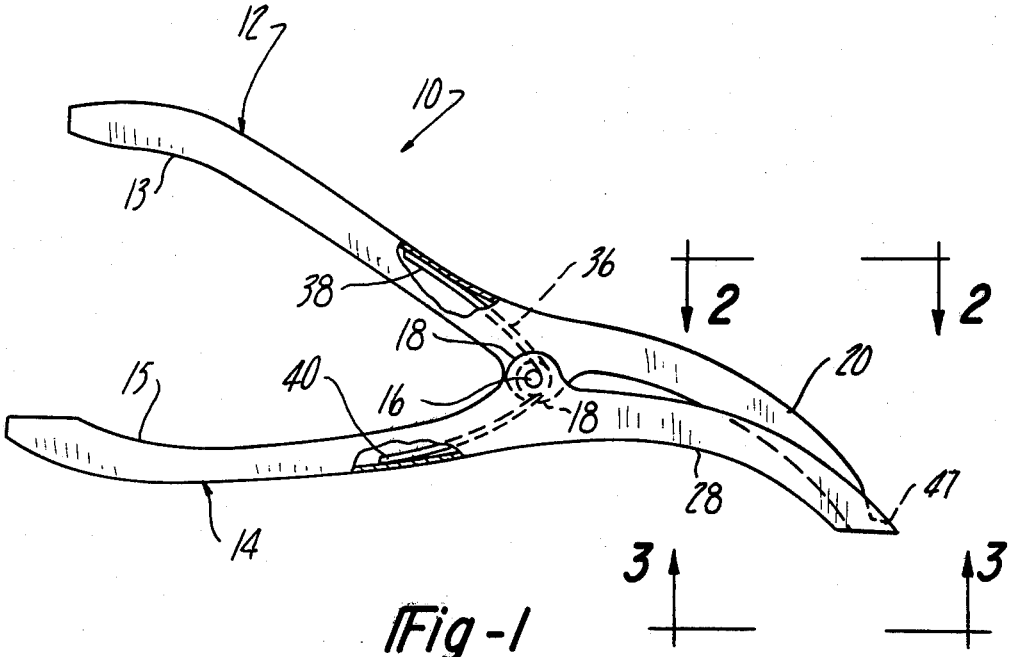
FIG. 1 is a side elevational view of an apparatus for removing embedded fasteners constructed in accordance with the principles of the present invention.

Referring now to the drawing and, in particular, to FIG. 1 wherein there is illustrated one example of the present invention in the form of a nail-extracting apparatus 10. The apparatus 10 comprises a pair of levers 12 and 14 secured to each other at a pivot point by means of a pin or rivet arrangement 16. Each of the levers includes a pair of intermediately disposed bosses 18 which define a suitable bearing support for the rivet 16 to permit a simple attachment of the levers 12 and 14. The rear portions of each lever 12 and 14 are suitably curved to define handles 13 and 15 to permit the levers 12 and 14 to be manipulated in a manner which will be described in greater detail hereinafter. The lever 12 has an integral curved arm portion 20 which terminates at its forward end in a pair of claw-like fingers 22 and 24 (FIG. 2), which will be described in greater detail hereinafter. Similarly, the lever arm 14 has an integral curved arm portion 28 that is concave in cross section such that its inner surface 27 (FIG. 2) receives the arm member 20 of the lever 12 when the handles 13 and 15 are spread apart in the manner illustrated in FIG. 1. The arm portion 28 terminates in a pair of support members 30 and 32 and are laterally spaced apart a sufficient distance to permit the claw-like fingers 22 and 24 to be nestled thereinbetween when the handles 13 and 15 are in the expanded position, as illustrated in FIGS. 1 through 3.

A spring 36 has a wound portion circumscribing the rivet 16, while the extended ends 38 and 40 of the spring 36, respectively, engage the underside of the handles 13 and 15 exerting a bias against the same to maintain the handles in the opened or extended position illustrated in FIG. 1. In this extended position the claw-like fingers 22 and 24 are nestled between the support members 30 and 32 and in position for engaging the shank of a fastener, as will be described hereinafter in greater detail.

Figure 2:
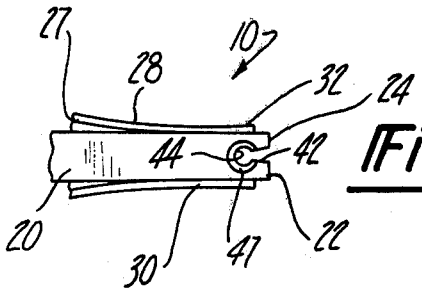
FIG. 2 is a fragmentary top plan view of the apparatus as seen from Line 2—2 of FIG. 1.
Figure 3:
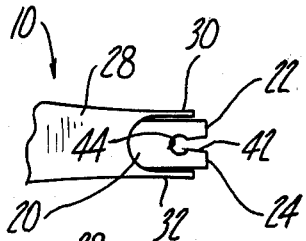
FIG. 3 is a fragmentary bottom elevational view of the apparatus as seen from Line 3—3 of FIG. 1.

Referring now to FIG. 2 wherein there is illustrated an enlarged plan view of fingers 22 and 24. It can be seen that the fingers 22 and 24 define a V-shaped groove 42 which terminates in a circular slot 44 adapted to receive the shank of a fastener, such as the shank 45 of the nail 46 illustrated in FIG. 4, such that the top surface 47 of the finger-like claws 22 and 24 may be inserted under the head 49 of the fastener 46 and exert an upward force against the fastener 46 to effect the removal of the same, as will be described hereinafter. As can best be seen in FIG. 1, the claw-like fingers 22 and 24 have an inclined surface 49 which facilitates the prying of the fingers under the head 49 of the fastener 46 to permit engagement of the shank 45 of the fastener 46 into the circular slot 44. Once the apparatus 10 has been manipulated so as to securely engage the fastener shank 45 within the slot 44, the user grasps the handles 13 and 15 and manually operates the tool in a manner similar to the operation of a pair of pliers in that the handles 13 and 15 are opened and closed with the hand in the customary manner.

It can be seen that when a compressive force is applied against the handles to close them, the pivotal cooperation between the front arm portions of the tool will cause a separation between the support members 30 and 32 and the claw-like fingers 22 and 24. Since the support members 30 and 32 are abutting the surface within which the fastener 46 is embedded, compression of the handles 13 and 15 results in the separation of the forward ends of the levers with the arm portion 20 being raised with respect to the support arms 30 and 32 whereby a force is exerted on the underside of the nail head and thereby effects withdrawal of the nail 46 from the material within which it is embedded.

Figure 4:
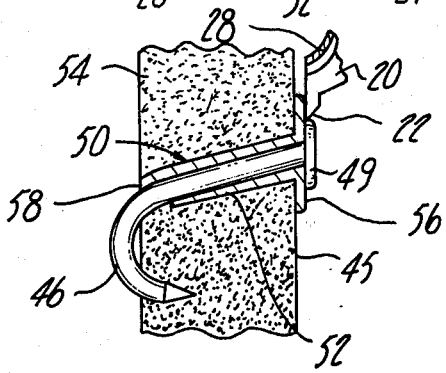
FIG. 4 is a fragmentary partially cross-sectional view of the claw-like fingers of the apparatus illustrated in FIG. 1 in the process of engaging an embedded fastener for purposes of removing the same.

As can be seen in FIG. 4, the present invention has particular application with respect to the removal of fasteners from wall anchors of the type disclosed in the aforementioned patent application. Briefly, the anchors 50 disclosed therein comprise a tubular member 52 which is inserted within a dry-wall 54 or similar plasterboard material until a driving surface 56 abuts the wall 54. The lower end of the tubular member 52 is provided with a deformed portion 58 which functions to deflect the end of the nail 46 driven therein such that the nail end is laterally curved and deeply embedded within the back side of the dry-wall 54 to secure the anchor thereto. This unique anchor provides a simple and easy means for the user to mount various articles, pictures and the like, to plasterboard, wallboard, and the like.

The apparatus 10 is ideally suited to be inserted under the head 49 of the fastener 46 such that the claw-like fingers 22 and 24 exert an upward force against the nail 46 to permit the shank 45 of the nail 46 to be received within the circular slot 44. Once in position a compressive force is exerted against the handles 13 and 15 effecting withdrawal of the nail 46 from the material within which it is embedded. It can be seen that the support arms 30 and 32 are so spaced so as to engage the top of the driving surface 56 of the tubular member 52 such that the nail 46 is withdrawn, while the tubular member remains in position in the wall 54 whereby the deformed end of the tubular member functions to straighten the nail 46 as it is withdrawn.

The foregoing is considered as illustrative only of the principles of the present invention, since numerous modifications and changes will readily occur to those skilled in the art of nail extractors and similar devices, and thus it is not desired to limit the present invention to the exact construction and operation as shown and described; and accordingly all suitable modifications and equivalence may be resorted to which fall within the spirit of the present invention and scope of the appended claims.

What is claimed as new and inventive and to which Letters Patent is sought is as follows:

1. In an apparatus for extracting an embedded nail from a surface, said apparatus being of the type comprising a pair of spaced apart lever arms having cooperating claw-like terminal ends, the improvement comprising:

a first lever having at its forward end a pair of claw-like fingers, the inner opposing surfaces of which terminate in a nail shank receiving slot, the fingers having inclined surfaces extending from the projecting ends of said fingers rearwardly toward said slot;

a second lever complemental to said first lever and having at its forward end a pair of spaced parallel support members, the lower edges of which are adapted to abuttingly engage said nail-carrying surface when said nail is positioned in said shank receiving slot and said claw-like fingers are disposed between said support members; and means pivotally connecting said levers to each other such that, when the rear ends of said levers are brought together, the forward ends of said levers are spread apart for exerting a force against said nail and extracting said nail from the surface within which said nail is embedded.

2. The improvement defined in claim 1 further comprising spring means engaging said levers for biasing said forward ends of said levers toward each other and seating said claw-like fingers between said support members.

3. The improvement defined in claim 1 wherein said pivotally connecting means comprises cooperably aligned projections formed on said levers; and a pin extending through said projections for connecting said levers, said second lever being concavely shaped between said pin and said parallel support members for receiving and supporting the forward portion of said first lever.

4. The improvement defined in claim 1 wherein the inner opposing surfaces of said claw-like fingers define a V-shaped groove.

* * * * *